United States Patent [19]

Wedge et al.

[11] 4,109,845

[45] Aug. 29, 1978

[54] SNAP DIES

[76] Inventors: Donald G. Wedge, 2008 Riverside Dr. E., Bradenton, Fla. 33508; Albert W. Zirkelbach, 2819 62nd Ave. East, Bradenton, Fla. 33505

[21] Appl. No.: 826,415

[22] Filed: Aug. 22, 1977

[51] Int. Cl.[2] ..... B25C 7/00

[52] U.S. Cl. ..... 227/144; 81/423; 29/268; 227/149

[58] Field of Search ..... 29/268; 81/421–424; 227/144, 149, 147; 72/409

[56] References Cited

U.S. PATENT DOCUMENTS

| | | | |
|---|---|---|---|
| 3,171,132 | 3/1965 | Dritz | 81/423 |
| 3,517,874 | 6/1970 | Cressy | 227/144 |
| 3,808,870 | 5/1974 | Blancett | 81/423 |
| 3,874,578 | 4/1975 | Derr et al. | 227/144 |

*Primary Examiner*—James L. Jones, Jr.
*Attorney, Agent, or Firm*—Stein & Frijouf

[57] ABSTRACT

A device is disclosed for attaching a snap fastener having a first and a second snap fastener portion to a material. The device is adapted for use with pliers having a first and a second plier jaw. The invention comprises a first and a second support capable of mounting on the first and the second plier jaw. First and second threaded fasteners respectively secure the first and second supports to the first and second plier jaws. A first die insert includes a projection for locating the first snap fastener portion of the snap fastener relative to the first die insert. A second die insert including internal resilient means locates the second snap fastener portion of the snap fastener relative to the second die insert. First and second apertures are located in the first and second supports for respectively receiving the first and second die inserts. The material is interposed between the first and the second die inserts when the first and second plier jaws are in an open position to attach the first and second snap fastener portions to the material when the first and second plier jaws are moved to the closed position.

10 Claims, 8 Drawing Figures

SNAP DIES

BACKGROUND OF THE INVENTION

1. Field of the Invention

This invention relates to attachment devices and more particularly to attachment dies cooperable with pliers for attaching conventional snap fasteners to a fabric or a material.

2. Description of the Prior Art

The demand for custom canvas, nylon and other fabric installations continues to increase as a result of greater leisure time now available to the consumer. These installations may include nylon, canvas or similar fabric material used for awnings, coverings or the like. In general, awnings for home, mobile home and camping trailers must be custom fitted to a particular application, size and desire of the owner. Coverings for boats, tents and the like must also be custom fitted for the particular use and desire of the owner. Another application for custom covers is for soft convertible tops for custom automobiles. The termination of factory production of convertible top automobiles has resulted in a boom to custom car builders of soft convertible automobiles requiring custom soft covers.

In general, the aforementioned covering material incorporates snap fastening devices for interlocking fabric sections, or for securing the fabric material to the house, boat or motor vehicle. The snap fastening devices generally comprise a male and a female snap fastener engagable with one another in a snap locking engagement. Each of the male and female snap fasteners comprise a first and a second snap fastener portion. The first and second snap fastener portions are secured to one another with the fabric material interposed therebetween thereby attaching either the male or the female snap fastener to the material. The first and second snap fastener portions are normally secured to one another by attachment dies connected to means for applying a substantial pressure for deforming at least one of the first and second snap fastener portions to secure the snap fastener to the material. In general, the die and the high pressure means were located in central installations requiring the custom cover or awning to be manufactured within an awning or canvas plant.

Unfortunately, the rising cost of labor, transportation and the like have made it economically unfeasible to produce custom installations for homes, boats, automobiles and the like at a central awning plant. Accordingly, some in the prior art have attempted to use portable snap fastening devices for use on the locations of the custom installation of the awning or covering. Some in the prior art have attempted to incorporate die attachments for plier devices for securing snap fasteners to a material. Unfortunately, none of the prior art devices have found widespread use since they were either overly complex and expensive or lacked the reliability required for professional custom installers of canvas material and the like. Accordingly, there is need in the prior art for a device for attaching snap fasteners to a material adapted for use with pliers which is inexpensive to produce while being reliable and capable of mounting to a large variety of prior devices.

Therefore it is an object of this invention to provide an apparatus which overcomes the aforementioned inadequacies of the prior art devices and provides an improvement which is a significant contribution to the advancement of the attachment art.

Another object of this invention is to provide a device for attaching snap fasteners to a material having a first and a second support unit capable of being mounted on a first and a second plier jaws with first and second thread fasteners for respectively securing the first and second support units to the first and second plier jaws.

Another object of this invention is to provide a device for attaching snap fasteners to a material comprising a first die insert including a projection for locating a first snap fastener portion relative to the first die insert and a second die insert including internal resilient means for locating a second snap fastener portion relative to the second die insert.

Another object of this invention is to provide a device for attaching a snap fastener to a material having a first and a second support unit including leg portions extending along opposed sides of the first and second plier jaws with threaded screw means extending through each of the leg portions to contact opposed sides of each of the first and second plier jaws.

Another object of this invention is to provide a device for attaching snap fasteners to a material wherein the first and second support units may be economically manufactured from a substantially cylindrical stock material by milling a slot therethrough forming plural legs for contacting opposed sides of the first and second plier jaws.

Other objects and a fuller understanding of this invention may be had by referring to the summary of the invention, the description and the claims, taken in conjunction with the accompanying drawings.

SUMMARY OF THE INVENTION

The invention may be incorporated into a device for attaching a snap fastener having a first and a second snap fastener portion to a material. The device is adapted for use with pliers such as lockable pliers having a first and a second plier jaw. A first and a second support unit is mountable to the first and second plier jaws respectively. First and second thread fastening means respectively secures the first and second support units to the first and second plier jaws. A first die insert means including a projection locates the first snap fastener portion of the snap fastener relative to the first die insert means. A second die insert means including internal resilient means locates the second snap fastener portion of the snap fastener relative to the second die insert means. First and second apertures are located in the first and second support units for respectively receiving the first and the second die insert means. The material is interposed between the first and second die insert means when the first and second plier jaws are in an open position. The first and second snap fastener portions are attached to one another and to the material when the first and second plier jaws are moved to the closed position.

More specifically, the invention may incorporate a device wherein the first and second die insert means are selected from a substantially harder material, such as steel, then the first and second support means. The first and second support means may be constructed of aluminum stock. In one embodiment, each of the first and second support units includes a leg portion extending along opposed sides of the first and second plier jaws. The first and second aperture means are established adjacent the working surface of the first and second plier jaws. The first and second threaded fastening means may be threaded screws extending through each of the leg portions to contact opposed sides of each of the first and second plier jaws.

In another example of the invention, each of the first and second support units includes a substantially cylindrical region adjacent to the working surface of the first and second plier jaws. Plural leg portions extend from each of the substantially cylindrical regions for cooperation with opposed side surfaces of each of the first and second plier jaws. Each of the leg portions includes a partially cylindrical configuration having a cylindrical diameter commensurate with the cylindrical diameter of the cylindrical region. In this embodiment, the support units may be fabricated by milling slots through the central region of substantially cylindrical stock forming the leg portions for contacting the first and second plier jaws.

In one example, the plier jaws include a jaw support and enlarged jaw lip. The jaw support has opposed external jaw surfaces whereas the enlarged jaw lip has a working surface and opposed external jaw lip surfaces. The plural leg portions of each of the support units simultaneously contact the opposed external jaw lip surfaces. Threaded fasteners extend through the leg portions for simultaneously engaging the opposed external jaw support surfaces.

In one embodiment, the second die insert means includes a wall defining a recess in the second die insert means. A groove extends into the wall of the recess for only partially receiving the resilient means therein. The resilient means may be in the form of a O-ring made of a rubber or similar material.

This invention accordingly comprises an apparatus possessing the features, properties and the relation of elements which will be exemplified in the apparatus hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION

Figure 1:
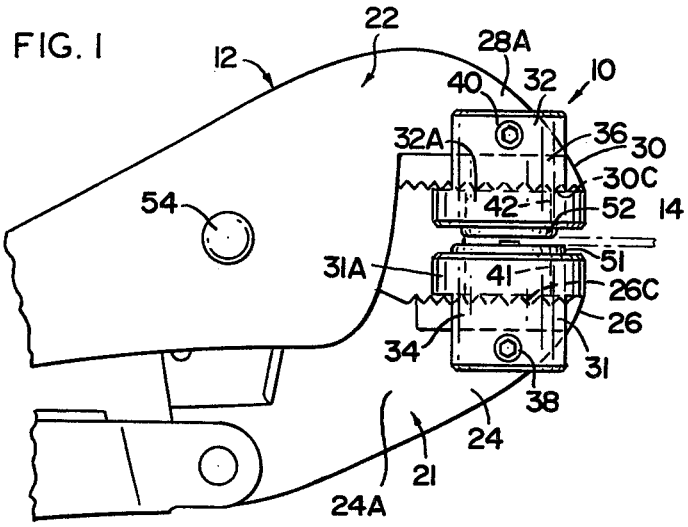
FIG. 1 is a side elevational view of a device for attaching snap fasteners shown mounted on and adapted for use with pliers.
Figure 2:
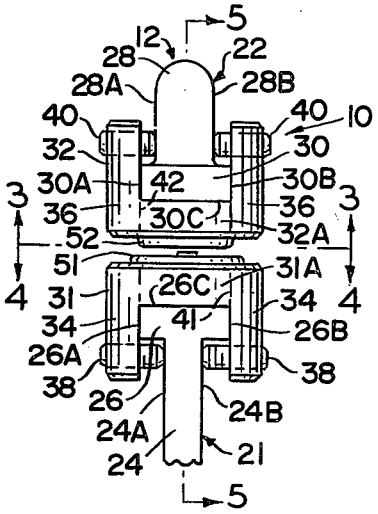
FIG. 2 is a front elevational view of the device shown in FIG. 1.

FIGS. 1 and 2 are side and front elevational views of a device 10 adapted for use with pliers 12 for attaching snap fasteners (not shown) to a material 14. The pliers 12 in this embodiment are shown as lockable pliers having a first and a second plier jaw 21 and 22. The first plier jaw 21 includes a jaw support 24 having opposed first external jaw support surfaces 24A and 24B. The jaw support 24 also includes a first enlarged jaw lip 26 having opposed jaw lip surfaces 26A and 26B and a working surface 26C. The second plier jaw 22 similarily comprises a second jaw support having opposed second jaw support surfaces 28A and 28B. The jaw support 28 further comprises a second enlarged jaw lip 30 having opposed jaw lip surfaces 30A and 30B and a working surface 30C.

The first and second jaws 21 and 22 respectively receive first and second support units 31 and 32. The first and second support units 31 and 32 are shown as generally cylindrical units having substantially cylindrical regions 31A and 32A established adjacent the working surfaces 26C and 30C of the first and second plier jaws 21 and 22. The first and second support units 31 and 32 include leg portions 34 and 36 which respectively cooperate with the opposed jaw lip surfaces 26A and 26B of the first plier jaw 21 and the opposed jaw lip surfaces 30A and 30B of the second plier jaw 22. The leg portions 34 and 36 are shown as partially cylindrical leg members having a cylindrical diameter commensurate with the cylindrical diameter of the cylindrical regions 31A and 32A of the first and second support units 31 and 32. The support units 31 and 32 may be fabricated by milling a slot through the central region of a substantially cylindrical stock forming the leg portions for contacting the opposed jaw lip surfaces as shown. First and second threaded fastening means shown as plural screws 38 and 40 threadably extend through the leg portions 34 and 36 respectively for contacting the opposed jaw support surfaces 24A and 24B of the first jaw support 24 and opposed jaw support surfaces 28A and 28B of the second jaw support 28. The screw threads 38 and 40 secure the first and second support units 31 and 32 relative to the first and second plier jaws 21 and 22 for securing the first and second snap fastener portions to one another as will be hereinafter explained.

The first and second support units 31 and 32 include first and second apertures 41 and 42 for respectively receiving first and second die insert means 51 and 52 for attaching the first snap fastener portion (not shown) to the second snap fastener portion (not shown). In this embodiment, apertures 41 and 42 are shown as through apertures with the first and second die insert means 51 and 52 contacting the working surfaces 26C and 30C of the first and second plier jaws 21 and 22. The first and second die insert means 51 and 52 are selected from a substantially harder material such as steel than the first and second support units 31 and 32. The first and second support means 31 and 32 may be constructed of aluminum stock which can be easily milled to provide leg portions 34 and 36. The pressure on the working surfaces 26C and 30C of the first and second plier jaws 21 and 22 is directly applied to the harder material of the die insert means 51 and 52. Accordingly, the first and second support units 31 and 32 merely position and establish the first and second die insert means 51 and 52 relative to the first and second plier jaws 21 and 22. The support units 31 and 32 do not transfer pressure between the plier jaws 21 and 22 and the snap fasteners (not shown).

The first and second plier jaws 21 and 22 pivot about a pivot pin 54 upon application of force to the handles (not shown) of the pliers 12 as is well known in the art. The pressure is transferred through the first and second plier jaws 21 and 22 directly to the first and second die inserts 51 and 52.

Figure 3:
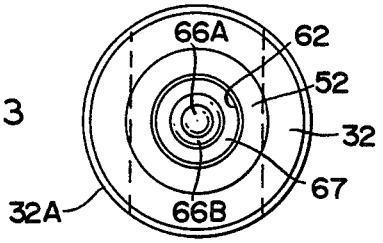
FIG. 3 is a view along line 3—3 in FIG. 2 showing in greater detail the internal configuration of the upper die shown in FIGS. 1 and 2.
Figure 4:
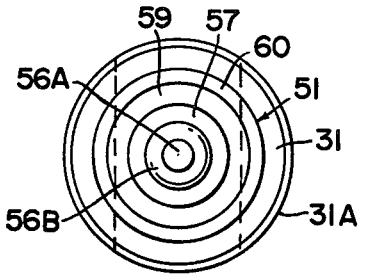
FIG. 4 is a view along line 4—4 in FIG. 2 showing in greater detail the internal configuration of the lower die shown in FIGS. 1 and 2.
Figure 5:
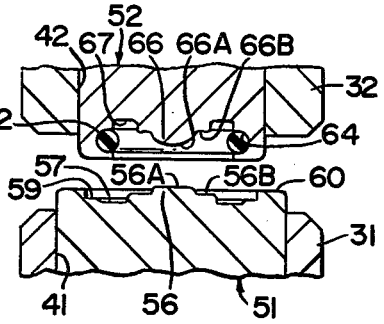
FIG. 5 is a partial sectional view along line 5—5 in FIG. 2.

FIG. 3 shows an elevational view of the second die insert means 52 whereas FIG. 4 shows an elevational view of the first die insert means 51. FIG. 5 shows a magnified view in section along line 5—5 in FIG. 2 of the first and second die insert means 51 and 52 and portions of the first and second support units 31 and 32. The first die insert means 51 shown in FIGS. 4 and 5 comprises a projection 56 having a first projection surface 56A and a second projection surface 56B established concentric and at different levels from a base surface 57 of the first die insert means 51. An annular ledge 59 interconnects the base 57 with the outer perimeter edge 60 of the first die insert means 51.

The second die insert means 52 shown in FIGS. 3 and 5 includes an internal resilient means shown as Oring 62 receivable within a groove 64 in an internal side wall of the second die insert means 52. The second die insert means 52 also includes a projection 66 having projection surfaces 66A and 66B established at a first and a second level relative to a base 67 of the second die insert means 52.

The first and second die insert means 51 and 52 are adapted to receive a first and a second snap portion for securing the snap portions to one another and to the material 14. For example, the first die insert 51 may receive an eyelet whereas the second die insert means 52 may receive a stud, both sold under the trademark DURABLE DOT. The material 14 is interposed between the first and second die insert means 51 and 52 when the first and second plier jaws 21 and 22 are in the open position as shown in FIGS. 1 and 2. The first and second snap fastener portions are attached to one another and to the material 14 when the first and second plier jaws 21 and 22 are moved to the closed position is well known in the art).

The dies shown in FIGS. 1–5 are normally used to secure what is well known in the art as a male snap fastener.

Figure 6:
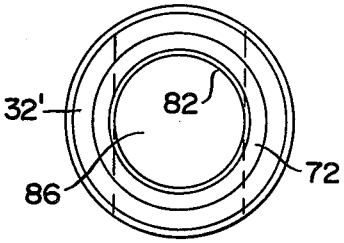
FIG. 6 is a view similar to FIG. 3 of an upper die of a second pair of dies for attaching a second snap fastener to a material.
Figure 7:
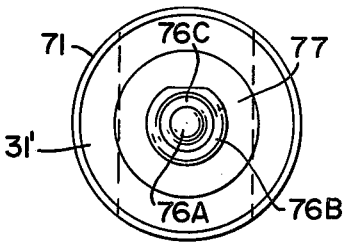
FIG. 7 is a view similar to FIG. 4 of a lower die of a second pair of dies for attaching a second snap fastener to a material.
Figure 8:
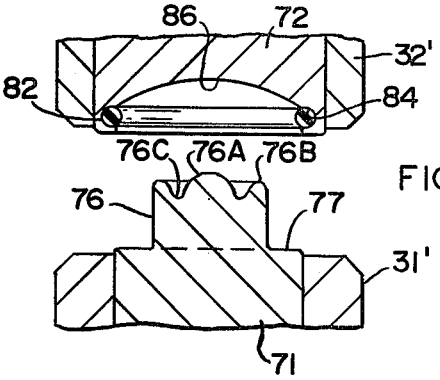
FIG. 8 is a sectional view similar to FIG. 5 for the second snap fasteners shown in FIGS. 6 and 7.

The die insert means 71 and 72 show in FIGS. 6–8 are adapted for securing a female snap fastener to the material 14. The die insert means 71 and 72 are mounted to first and second support units 31' and 32' in a substantially identical manner as die insert 51 and 52 are mounted to the first and second support units 31 and 32. The first die insert means 71 comprises a projection 76 having projecting surfaces 76A and 76B with an annular groove 76C interposed therebetween. Projection 76 extends relative to the base 77 of the first die insert means 71. The second die insert means 72 comprises resilient means shown as Oring 82 receivable within a groove 84 and an internal side wall of the second die insert means 72. The base 86 is substantially dish-shaped for receiving the smooth rounded portion of the snap fastener. The first die insert 71 is suitable for receiving the socket of a DURABLE DOT snap fastener portion whereas the second die insert 72 is suitable for receiving a button of a DURABLE DOT fastener.

The instant invention has been described in combination with a specific type of snap fastener, but it is understood that this disclosure has been made only by way of example and that the instant invention is adaptable for numerous types of snap fasteners. In addition, the actual process of interconnecting the snap fastener portion with the material has not been presented since this is also considered to be well known in the art. A substantial aspect of the invention is the ability to transfer force from the plier jaws directly to the die insert means with support units securing the die insert means relative to the working surfaces of the plier jaws.

The present disclosure includes that contained in the apended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention.

Now that the invention has been described:

We claim:

1. A device for attaching a snap fastener having a first and a second snap fastener portion to a material, the device being adapted for use with pliers, having a first and a second plier jaw, comprising in combination:

a first and a second support unit capable of mounting to the first and the second plier jaws, respectively;

first and second threaded fastening means for respectively securing said first and said second support units to the first and the second plier jaws;

first die insert means including a projection for locating the first snap fastener portion of the snap fastener relative to said first die insert means;

second die insert means including internal resilient means for locating the second snap fastener portion of the snap fastener relative to said second die insert means; and first and second aperture means in said first and said second support units for respectively receiving said first and said second die insert means enabling the material to be interposed between said first and said second die insert means when the first and the second plier jaws are in an open position and for attaching the first and the second snap fastener portions to the material when the first and the second plier jaws are moved to a closed position.

2. A device as set forth in claim 1, wherein said first and said second die insert means are selected from a substantially harder material than said first and second support units.

3. A device as set forth in claim 1, wherein each of said first and said second support units includes a leg portion extending along opposed sides of the first and second plier jaws; and said first and said second aperture means being adjacent to the working surface of the first and the second plier jaws, respectively.

4. A device as set forth in claim 3, wherein said first and said second threaded fastening means includes a threaded screw extending through each of said leg portions to contact the opposed sides of each of the first and the second plier jaws.

5. A device as set forth in claim 1, wherein each of said first and second support units includes a substantially cylindrical region adjacent to the working surface of the first and the second plier jaws, respectively; and plural leg portions extending from each of said substantially cylindrical regions for cooperation with opposed side surfaces of each of the first and the second plier jaws.

6. A device as set forth in claim 5, wherein each of said leg portions includes a partially cylindrical configuration having a cylindrical diameter commensurate with the cylindrical diameter of said cylindrical region.

7. A device as set forth in claim 1, wherein said second die insert means includes a wall defining a recess in said second die insert means; and groove means extending into said wall of said recess for only partially receiving said resilient means therein.

8. A device as set forth in claim 7, wherein said resilient means includes O-ring means.

9. A device as set forth in claim 1, wherein each of said plier jaws includes a jaw support and an enlarged jaw lip;

said jaw support having opposed external jaw support surfaces;

said enlarge jaw lip having a working surface and opposed external jaw lip surfaces;

each of said support units having plural leg portions for simultaneously contacting said opposed external jaw lip surfaces; and each of said first and second threaded fastening means including threaded fasteners threadably extending through said leg portions for simultaneously engaging said opposed external jaw support surfaces.

10. A device as set forth in claim 1, wherein said first and said second die insert means are substantially harder than said first and second support units;

said first and second aperture means being through apertures enabling said first and second die insert means to directly contact the first and second plier jaws respectively to apply the plier jaw pressure only through said first and second die insert means to the first and second snap fastener portions.

* * * * *